US008112830B2

(12) United States Patent
Brown

(10) Patent No.: US 8,112,830 B2
(45) Date of Patent: Feb. 14, 2012

(54) NECK GUARD FOR USE IN A HAIR-WASHING SINK

(76) Inventor: Kelley Brown, Austin, TX (US)

( * ) Notice: Subject to any disclaimer, the term of this patent is extended or adjusted under 35 U.S.C. 154(b) by 906 days.

(21) Appl. No.: 12/126,898

(22) Filed: May 25, 2008

(65) Prior Publication Data

US 2008/0289092 A1 Nov. 27, 2008

Related U.S. Application Data

(60) Provisional application No. 60/940,351, filed on May 25, 2007.

(51) Int. Cl.
*A45D 44/10* (2006.01)
*A61G 15/12* (2006.01)

(52) U.S. Cl. ..... 4/519; 4/523; 4/575.1; 297/283.4; 297/220; 297/221; 297/440.11; 2/50

(58) Field of Classification Search ..... 4/515–517, 4/519–520, 522–523, 575; 297/440.1, 283.1, 297/283.4, 220–221, 219.1, 391–400, 406–410, 297/440.11, 440.14; 2/174, 468, 50, 46
See application file for complete search history.

(56) References Cited

U.S. PATENT DOCUMENTS 1,168,842 A * 1/1916 Albrecht ..... 297/221
1,298,235 A * 3/1919 McCrillis ..... 297/283.4
2,874,468 A * 2/1959 De Woskin ..... 433/5
3,649,075 A * 3/1972 Kalkowski ..... 297/220
4,056,281 A * 11/1977 Byrnes ..... 297/220
4,285,075 A * 8/1981 Nelson ..... 4/251.1
4,669,132 A * 6/1987 Courson ..... 4/523
4,763,364 A 8/1988 Morgan
4,864,667 A 9/1989 Adams
4,949,407 A * 8/1990 Singer et al. ..... 4/523
5,377,365 A * 1/1995 Hakim ..... 4/523
5,896,595 A 4/1999 Spencer
5,934,754 A * 8/1999 Raffa ..... 297/392
6,550,078 B1 4/2003 Brown
7,203,983 B1 * 4/2007 Reeves et al. ..... 5/636
2004/0036329 A1 * 2/2004 Ashton et al. ..... 297/220
2006/0255634 A1 * 11/2006 Gallo ..... 297/220
2007/0210626 A1 * 9/2007 Aubriet et al. ..... 297/220

* cited by examiner

*Primary Examiner* — Jeanette E. Chapman
(74) *Attorney, Agent, or Firm* — Law Offices of Mark L. Berrier

(57) ABSTRACT

A neck guard for a salon/barber industry sink, wherein the sink has an indentation in a lip of the sink to accommodate a person's neck. The neck guard includes a lower layer, a cushioning layer and a cover layer. The lower layer is flexible and incorporates fasteners such as suction cups configured to removably attach the lower layer to the sink. The cushioning layer is bonded to the lower layer and has a surface that is suitable for having the cover layer attached to it by means such as a low-tack, pressure-sensitive adhesive. The neck guard is sufficiently flexible to wrap around and conform to the indentation in the lip of the sink and to enable attachment of the fasteners to the sink, thereby securing the neck guard within the indentation in the lip of the sink.

18 Claims, 2 Drawing Sheets

NECK GUARD FOR USE IN A HAIR-WASHING SINK

CROSS-REFERENCE TO RELATED APPLICATIONS

This application claims the benefit of U.S. Provisional Patent Application 60/940,351, filed May 25, 2007, which is hereby incorporated by reference as if set forth herein in its entirety.

BACKGROUND

1. Field of the Invention

The invention relates generally to the salon/barber industry, and more specifically to a neck support for a hard surface sink in the beauty industry.

2. Related Art

Hairstylists often use a specially designed sink to shampoo or rinse chemicals out of their clients' hair. These sinks typically have a curved indentation in the lip in order to allow the person whose hair is being washed/colored to comfortably rest his/her head on the lip of the sink.

All barber/cosmetologist sinks have a very hard surface, so it may not be comfortable for a client to rest his/her neck on the lip of the sink. A cushion (sometimes referred to as a neck guard) is often placed on the lip of the sink at the indentation in order to make the client more comfortable.

Conventional cushions are thick pieces of foam that are molded so that they fit over the indentation in the lip of the sink. The foam must be thick in order to enable the cushion to maintain its shape and thereby maintain its position in the indentation. Because conventional neck guards are normally very thick, they may cause the client's head to rest at an uncomfortable angle. If the client has problems with his or her neck, this may be so uncomfortable as to be intolerable.

Conventional neck guards also typically allow water or other liquids to run down the neck of the client, causing discomfort and potentially ruining the client's clothes. It would therefore be desirable to provide an improved net guard which is more comfortable for the client, and also prevents liquids from running down the client's neck.

SUMMARY OF THE INVENTION

This disclosure is directed to neck guards for salon/barber industry sinks that solve one or more of the problems discussed above. In one particular embodiment, a neck guard includes a lower layer, a cushioning layer and a cover layer. The lower layer is flexible and incorporates fasteners such as suction cups that can removably attach the lower layer to the sink. The cushioning layer is bonded to the lower layer and provides padding between the lip of the sink and a client's neck. The cushioning layer has a surface that is suitable for having the cover layer attached to it by such means as a low-tack, pressure-sensitive adhesive. The neck guard is sufficiently flexible to wrap around and conform to the indentation in the lip of the sink and to enable attachment of the fasteners (e.g., suction cups) to the sink, thereby securing the neck guard within the indentation in the lip of the sink.

In one embodiment, the lower layer is molded from rubber and the suction cups are integrally formed in this layer. The suction cups may be spaced substantially equally across the extent of the neck guard in order to allow the neck guard to be secured over the indentation in the lip of the sink. The cushioning layer may be formed from an elastomer material, and may be thicker in a central portion that is positioned over the lip of the sink and thinner towards the edges of the neck guard. The neck guard may be very thin in comparison to a conventional neck guard (e.g., no more than ¾-1 inch.) The cover layer is removably attached to the cushioning layer, such as by a pressure sensitive adhesive. The cover layer may be a disposable paper material, or it may be a reusable (washable) fabric material, thereby enabling the neck guard to pass state licensing board regulations. In either case, the cover layer should be a breathable material that allows air to circulate to a user's neck and thereby improves the comfort of the neck guard. The neck guard may have a variety of shapes. For example, it may be substantially rectangular or hourglass shaped, or it may be generally rectangular with lateral (e.g., semicircular) portions on opposite sides of the rectangle so that the lateral portions cover the upper portions of the indentation in the lip of the sink.

In an alternative embodiment, a neck guard includes a lower layer, a cushioning layer and a cover layer, wherein the lower layer and the cover layer form an envelope around the cushioning layer. The lower layer is a flexible material such as rubber and incorporates fasteners such as suction cups that can removably attach the lower layer to the sink. The cushioning layer is a gel-type material that is sandwiched between the lower layer and the cover layer to provide padding between the lip of the sink and the client's neck. In this embodiment, the cover may be made of rubber, and is not removable but is instead permanently attached to the lower layer. The cover layer has an upper surface that is either washable or suitable for having a removable fabric or paper cover adhered to it. The neck guard is wrapped around the indentation in the lip of the sink and secured to provide a sanitary, leak-resistant cushion in the indentation in the lip of the sink.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
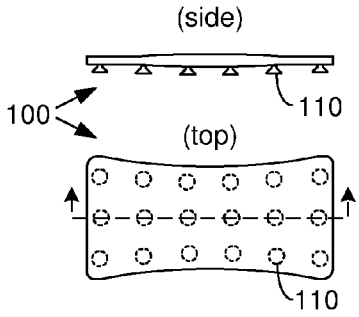
FIG. 1 is a diagram illustrating an improved neck guard in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF PREFERRED EMBODIMENTS

One or more embodiments of the invention are described below. It should be noted that these and any other embodiments described below are exemplary and are intended to be illustrative of the invention rather than limiting.

As described herein, various embodiments of the invention comprise neck guards that provide improved comfort and resistance to leakage between a client's neck and the lip of a salon/barber industry sink. In one embodiment, the neck guard is thin and relatively flexible in comparison to conventional neck guards. Rather than having a thick foam structure that maintains its shape in order to remain in place on the lip of the sink, the present neck guard uses a flexible layered structure. This structure includes a lower layer that has fasteners such as suction cups for attaching the neck guard to the lip of the sink. A cushioning layer is bonded to the lower layer and provides cushioning for the client's neck without being so bulky that it is uncomfortable. Finally, a removable upper layer is adhered to the cushioning layer in order to provide a protective layer between the neck guard and the client's neck. This layer is preferably a liquid impermeable paper that can be replaced before each use of the neck guard.

Referring to FIG. 1, one embodiment of an improved neck guard 100 is illustrated. FIG. 1 shows both a side view and a top view of the neck guard. In this embodiment, the neck guard is approximately 4 inches wide and 8 inches long. The neck guard varies in thickness but, in this embodiment, the neck guard is thinner near its edges and thicker near the center. This can be seen in the side view at the top of FIG. 1. The center portion of the neck guard is thicker than the edges because this portion will be positioned over the indentation in the lip of the sink, and the additional thickness provides greater cushioning for the client's neck.

The neck guard has a slightly rounded hourglass shape in this embodiment. The narrower center portion fits within the indentation in the sink, while the wider end portions wrap around the lip and fasten to the sides of the sink. This shape may be different in other embodiments, as will be explained in more detail below. In this embodiment, the neck guard includes a number of suction cups (e.g., 110) on its underside. The suction cups are spaced substantially evenly (i.e., approximately, but not necessarily exactly evenly) across the extent of the neck guard. The suction cups enable the neck guard to be adhered to the surface of the sink, thereby holding the neck guard in place within the indentation in the lip of the sink.

Figure 2:
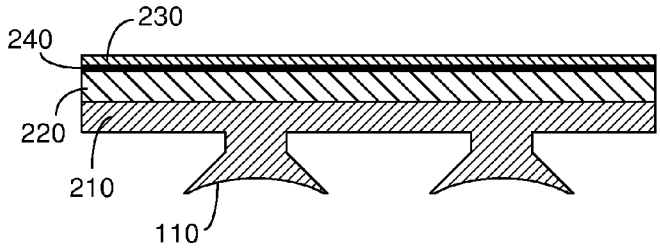
FIG. 2 is a diagram illustrating an enlarged cross-sectional view of a portion of the neck guard of FIG. 1.

FIG. 2 shows an enlarged cross-sectional view of a portion of the neck guard. In this embodiment, the neck guard includes three different layers. The lower layer 210 incorporates suction cups (e.g., 110) The suction cups are formed integrally with the lower layer by means such as injection molding. The suction cups are used to secure the neck guard to the sink.

A cushioning layer 220 is bonded to lower layer 210. Cushioning layer 220 may be molded and then bonded to lower layer 210 by gluing the two layers together, it may be molded on the lower layer, or it may be adhered to the lower layer by other means. The purpose of the cushioning layer is to provides padding between the sink and the client's neck, thereby improving the client's comfort.

A cover layer 230 is removably adhered to cushioning layer 220. Cover layer 230 is adhered to cushioning layer 220 by means of an adhesive 240. The adhesive may be a glue, wax or other type of low-tack pressure sensitive adhesive. Adhesive 240 allows cover layer 230 to be removed and reapplied to cushioning layer 220 (or removed and replaced by a new cover layer.)

As noted above, the neck guard is relatively thin in comparison with conventional neck guards. In one embodiment, the neck guard is no more than ¾-1 inch thick at its center (the portion that lies over the indentation in the lip of the sink.) Most of this thickness is due to the cushioning layer, as the lower and cover layers can be very thin, yet still strong enough to be durable. This thickness cannot be achieved by conventional neck guards, which must be much thicker in order to maintain a shape that conforms to the lip of the sink and thereby holds the neck guard in place.

Cover layer 230 is provided for sanitary purposes. When conventional neck guards are used, a client's neck lies directly on the neck guard. Hair, chemicals, dirt, oils, dirty water and the like can be transferred from the client's neck to the neck guard and may even be absorbed into the foam of the neck guard. The protective cover of the present neck guard prevents these materials from touching the body of the neck guard (specifically cushioning layer 220) and can be removed, discarded and replaced with a new cover, thereby preventing the unsanitary transfer of dirt and other substances from one client to another.

In this embodiment, the different layers of the neck guard are constructed with different materials. The bottom layer consists of rubber or a similar material, which is strong, yet flexible, and provides a measure of durability to the neck guard. Rubber is also sufficiently strong to form the suction cups which secure the neck guard to the sink.

The middle layer of the neck guard consists of a gel-type elastomer material (e.g., a thermoplastic elastomer.) This material should be sufficiently elastic to provide cushioning between the client's head and the lip of the sink (the rubber material of the lower layer is typically less elastic and does not provide significant cushioning.) The elastomer of the cushioning layer can be formed in appropriate thicknesses across the neck guard to provide suitable comfort to the neck guard.

The cover layer of the neck guard consists of a material such as paper or cloth. The cover layer is not intended to provide any cushioning or strength, but simply prevents the transfer of dirt, and other unsanitary materials from a client's neck to the cushioning layer. Conversely, if any of these unsanitary materials are deposited on the cushioning layer, removal of the cover layer and replacement with a new cover layer prevents transfer of the materials from the cushioning layer to the neck of the next client to use the neck guard.

The cover layer is preferably impermeable to the unsanitary materials, but if a material such as a permeable fabric is used, the cover layer may be washable so that it can be sanitized. Whether the cover layer is permeable or not, it is preferably made of a material that is "breathable" (i.e., allows some air to reach the client's neck) so that the neck guard is more comfortable.)

It should be noted that, despite the multiple layers of materials, the neck guard is still very thin in comparison with conventional neck guards, and therefore does not prop up the client's head at an uncomfortable angle. This allows the neck guard to the used with many clients who have neck problems and therefore cannot tolerate conventional neck guards. Also, because the neck guard does not prop up the client's head as high as conventional neck guards, the angle of the neck is lower and less water runs down the client's neck.

Figure 3:
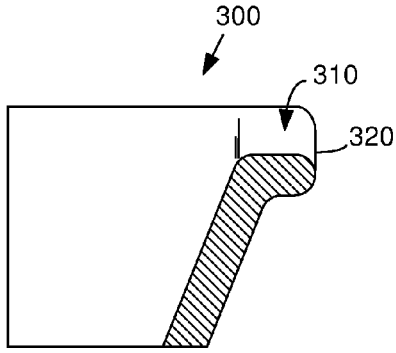
FIG. 3 is a diagram illustrating a cross-section of the lip of a typical salon/barber industry sink.

Referring to FIG. 3, a cross-section of the lip of a typical salon/barber industry sink 300 is shown. The cross-section of the sink is taken through the indentation 310 in the lip 320 of the sink. The client's head rests in this indentation when the client is in a reclined position with his or her head in the sink.

Figure 4:
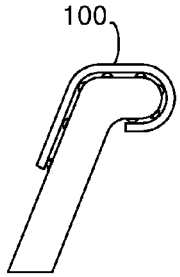
FIG. 4 is a diagram illustrating a cross-section of the lip of a salon/barber industry sink with a neck guard in accordance with one embodiment installed over the lip.
Figure 5:
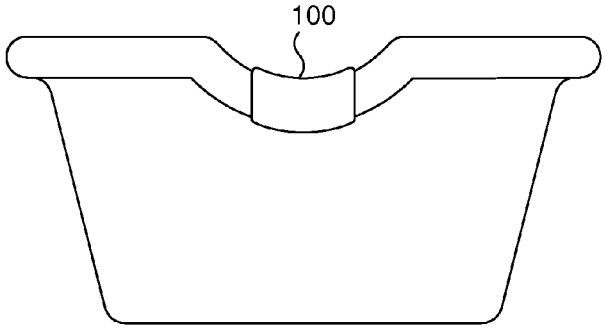
FIG. 5 is a diagram illustrating a front view of a hair washing sink with a neck guard in accordance with one embodiment installed over the lip.

Referring to FIGS. 4 and 5, the neck guard of FIG. 1 is shown installed on the lip of the sink. It can be seen that the suction cups on the underside of the neck guard fasten the neck guard to the sink. The suction cups are fastened to the sink on the inside of the sink, over the lip of the sink at the indentation, and under the lip of the sink.

It should be noted that there may be many variations in the features described above in alternative embodiments of the present neck guard. Several of these variations are illustrated in FIGS. 6-9.

Figure 6:
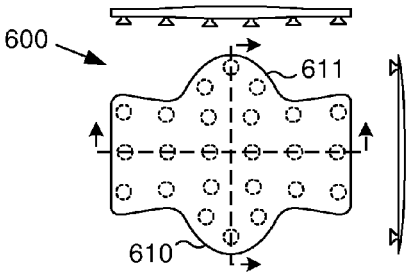
FIG. 6 is a diagram illustrating an improved neck guard in accordance with an alternative embodiment.
Figure 7:
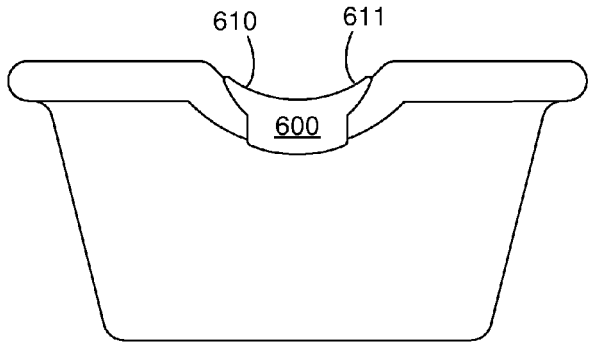
FIG. 7 is a diagram illustrating a front view of a hair washing sink with the neck guard of FIG. 6 installed over the lip.

Referring to FIG. 6, an alternative embodiment of the present neck guard is shown. This embodiment is very similar to the embodiment of FIG. 1, except that the neck guard has a shape which differs from the rectangular/hourglass shape of the previous embodiment. In the embodiment of FIG. 6, two lateral portions (610, 611) which in this embodiment are generally semicircular, are included in the neck guard 600. These lateral portions extend outward from the central portion of the neck guard, and are designed to extend upward along the sides of the indentation in the lip of the sink. The positioning of the neck guard on the sink is shown in FIG. 7. The addition of lateral portions 610 and 611 helps prevent water from running over the edge of the neck guard and getting between the neck guard and of the lip of the sink. It should be noted that these lateral portions may be semicircular, rectangular, or any other shape that is suitable for covering the sides of the indentation in the lip of the sink.

Figure 8:
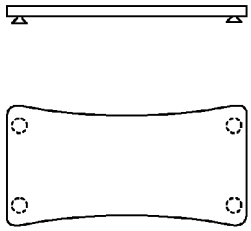
FIG. 8 is a diagram illustrating an improved neck guard in accordance with another alternative embodiment.
Figure 9:
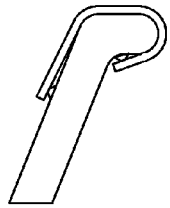
FIG. 9 is a diagram illustrating a cross-section of the lip of a salon/barber industry sink with the neck guard of FIG. 8 installed over the lip.

Referring to FIG. 8, another alternative embodiment of the present neck guard is shown. In this embodiment, the neck guard again has a rectangular/hourglass shape. This embodiment differs from the embodiment of FIG. 1 and that it only has suction cups at its four corners. These suction cups may, in some instances, be sufficient to hold the neck guard in place over the lip of the sink as shown in FIG. 9. It is, however, contemplated that additional suction cups (see, e.g., FIGS. 1 and 6) will usually be necessary to secure the neck guard in the proper position.

Figure 10:
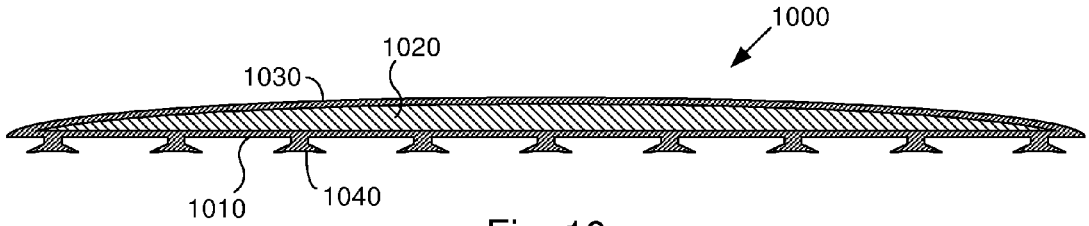
FIG. 10 is a diagram illustrating an improved neck guard in accordance with another alternative embodiment.

Referring to FIG. 10, another alternative embodiment of the present neck guard is shown. In this embodiment, neck guard 1000 includes a lower layer 1010, a cushioning layer 1020 and a cover layer 1030, wherein the lower layer and the cover layer form an envelope around the cushioning layer. The lower layer is a flexible material such as rubber and incorporates fasteners such as suction cups 1040 that can removably attach the lower layer to the sink. The cushioning layer is a gel-type material that is sandwiched between the lower layer and the cover layer to provide padding between the lip of the sink and the client's neck. In this embodiment, the cover may be made of rubber, and is not removable but is instead permanently attached to the lower layer. The cover layer has an upper surface that is either washable or suitable for having a removable fabric or paper cover adhered to it. The neck guard is wrapped around the indentation in the lip of the sink and secured to provide a sanitary, leak-resistant cushion in the indentation in the lip of the sink.

It should be noted that, while the cushioning layer is illustrated in FIG. 10 as extending to near the edges of the neck guard, this is not necessary in all embodiments. Because the cushioning provided by this layer is only needed over the lip of the sink, the cushioning layer may only extend over that portion of the neck guard.

Still other variations are also possible. For instance, the adhesive layer between the cushioning layer and the cover layer may consist of pieces of hook-and-loop material or other fasteners that are attached to the respective layers. Further, numerous other shapes of the neck guard may be possible.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A neck guard for a salon/barber industry sink, wherein the sink has an indentation in a lip of the sink to accommodate a person's neck, the neck guard comprising:

a flexible lower layer having one or more fasteners configured to removably attach the lower layer to the sink;

a flexible cushioning layer bonded to the lower layer, wherein the cushioning layer has a surface configured to enable a cover layer to be removably attached thereto; and a cover layer attached to the cushioning layer;

wherein the neck guard is sufficiently flexible to wrap around and conform to the indentation in the lip of the sink and to enable attachment of the fasteners to the sink, thereby securing the neck guard within the indentation in the lip of the sink, wherein the cover layer is removable from the cushioning layer and replaceable on the cushioning layer, and wherein the cover layer comprises a disposable paper material.

2. The neck guard of claim 1, wherein the neck guard has a thickness of no more than ¾ inch.

3. The neck guard of claim 1, wherein the fasteners comprise suction cups that are integrally formed in the lower layer.

4. The neck guard of claim 1, wherein the cushioning layer comprises an elastomer material.

5. The neck guard of claim 1, wherein the lower layer comprises a rubber material.

6. The neck guard of claim 1, wherein the cover layer comprises a breathable material that allows air to circulate to a user's neck which is positioned on the cover layer.

7. The neck guard of claim 1, further comprising an adhesive layer positioned between the cushioning layer and the cover layer and configured to adhere the cushioning layer to the cover layer.

8. The neck guard of claim 7, wherein the adhesive layer comprises a low-tack, pressure-sensitive adhesive.

9. The neck guard of claim 1, wherein the neck guard includes a substantially rectangular central portion and two lateral portions positioned on opposite sides of the substantially rectangular central portion, wherein the lateral portions are positioned to cover respective upper portions of the indentation in the lip of the sink when the neck guard is fastened to the sink.

10. A neck guard for a salon/barber industry sink, wherein the sink has an indentation in a lip of the sink to accommodate a person's neck, the neck guard comprising:

a flexible lower layer having one or more fasteners configured to removably attach the lower layer to the sink;

a flexible cushioning layer bonded to the lower layer, wherein the cushioning layer has a surface configured to enable a cover layer to be removably attached thereto; and a cover layer attached to the cushioning layer;

wherein the neck guard is sufficiently flexible to wrap around and conform to the indentation in the lip of the sink and to enable attachment of the fasteners to the sink, thereby securing the neck guard within the indentation in the lip of the sink, wherein the cover layer is removable from the cushioning layer and replaceable on the cushioning layer, and wherein the cover layer comprises a reusable cloth material.

11. The neck guard of claim 10, wherein the neck guard has a thickness of no more than ¾ inch.

12. The neck guard of claim 10, wherein the fasteners comprise suction cups that are integrally formed in the lower layer.

13. The neck guard of claim 10, wherein the cushioning layer comprises an elastomer material.

14. The neck guard of claim 10, wherein the lower layer comprises a rubber material.

15. The neck guard of claim 10, wherein the cover layer comprises a breathable material that allows air to circulate to a user's neck which is positioned on the cover layer.

16. The neck guard of claim 10, further comprising an adhesive layer positioned between the cushioning layer and the cover layer and configured to adhere the cushioning layer to the cover layer.

17. The neck guard of claim 16, wherein the adhesive layer comprises a low-tack, pressure-sensitive adhesive.

18. The neck guard of claim 10, wherein the neck guard includes a substantially rectangular central portion and two lateral portions positioned on opposite sides of the substantially rectangular central portion, wherein the lateral portions are positioned to cover respective upper portions of the indentation in the lip of the sink when the neck guard is fastened to the sink.

* * * * *